United States Patent [19]

Bekooy

[11] Patent Number: 4,540,395

[45] Date of Patent: Sep. 10, 1985

[54] REFOLDING AND STACKING RECEPTACLE FOR SEGMENTED SHEET MATERIAL

[76] Inventor: Jan T. Bekooy, 7670 SW. Barnard Dr., Beaverton, Oreg. 97007

[21] Appl. No.: 465,878

[22] Filed: Feb. 11, 1983

[51] Int. Cl.[3] ..... B65H 45/06

[52] U.S. Cl. ..... 493/410; 493/446

[58] Field of Search ..... 493/410, 411, 413, 414, 493/446, 419, 420

[56] References Cited

U.S. PATENT DOCUMENTS

| | | | |
|---|---|---|---|
| 3,123,269 | 3/1964 | Morley et al. | 493/410 |
| 3,178,172 | 4/1965 | Lettan | 493/411 |
| 3,355,164 | 11/1967 | Stolman | 493/413 |
| 3,514,096 | 5/1970 | Muller | 493/410 |
| 3,759,507 | 9/1973 | Imbrecht | 493/413 |
| 3,980,291 | 11/1976 | Loase | 493/433 |
| 4,358,285 | 11/1982 | Fujiso | 493/411 |

FOREIGN PATENT DOCUMENTS

| | | | |
|---|---|---|---|
| 20598 | 6/1972 | Japan | 493/414 |

OTHER PUBLICATIONS

IBM Technical Disclosure Bulletin, vol. 4, No. 1, Jun. 1961.

*Primary Examiner*—Lowell A. Larson
*Assistant Examiner*—Jorji M. Griffin
*Attorney, Agent, or Firm*—Eugene D. Farley

[57] ABSTRACT

A refolding and stacking receptacle for segmented sheet material, particularly computer printout paper. The receptacle has a support for supporting a stack of the material in flat, folded condition, a guideway positioned centrally of the support for receiving the leading end of a moving web of the material fed to the receptacle in an unfolded condition, and a stop in the guideway for arresting the motion of the material on contact. This results in zig-zag folding of the web and its stacking within the receptacle.

5 Claims, 6 Drawing Figures

REFOLDING AND STACKING RECEPTACLE FOR SEGMENTED SHEET MATERIAL

BACKGROUND AND BRIEF DESCRIPTION OF THE INVENTION

This invention pertains to receptacles for refolding and stacking segmented sheet material. It pertains particularly to receptacles of the class known as "printout baskets" commonly employed for receiving, folding and stacking printout paper as it is delivered by a computer driven printer. It is described herein specifically with respect to this application, although no limitation thereby is intended.

The receptacles or printout baskets commonly used for the reception, folding and storage of computer printout paper in large quantities conventionally comprise simple interwoven wire baskets adapted to catch the printout paper as it is discharged in large volume and at a high rate of speed from the associated computer. The baskets have for their purported function, receiving the leading end of the paper as it is discharged from the computer and falls gravitationally into the basket, guiding it into reverse folds, and stacking it in flat-folded condition until the operation of the computer has been completed.

The conventional catch baskets are relatively expensive. Also, they are inefficient in operation in that they do not guide the printout paper accurately, with the result that it snags and is caught in unfolded condition. This generates a great volume of an unfolded continuous length of paper which rapidly fills the basket and overflows onto the floor.

As a result, it is common practice to station an operator adjacent the discharge side of the computer for the purpose of manually guiding the printout paper into its folded condition, and stacking it in the basket. This obviously is wasteful of the operator's time and introduces an unnecessary cost factor into the operation of the computer.

It accordingly is the general object of the present invention to provide a refolding and stacking receptacle for segmented sheet material, such as computer printout paper, which receives, guides, refolds and neatly stacks the sheet material after it has been run through a processing device, in particular through a computer-driven printer.

Among the further objects of the invention are the provision of a refolding and stacking receptacle for computer printout paper and other segmented sheet material which:

(1) accommodates papers having a wide variety of commercial uses, (2) guides the paper positively and forces it to fold in the right direction, (3) prevents catching of the moving paper web on interior surfaces with resultant paper hangups, (4) allows for misalignment of the receptacle relative to the associated computer or other printing device, in both directions, (5) permits easy extraction of the finished stack of folded material, (6) is adaptable for use with sheet material of different widths without any adjustment, (7) is characterized by a side extraction feature permitting the associated printing device to be backed against a wall, (8) has no moving parts, (9) is characterized by long life in an office environment,

(10) generates a minimum amount of static electricity,

(11) without adjustment, can handle both single and multi-part papers,

(12) may be simply and inexpensively fabricated and assembled, from two identical parts of molded plastic or other structural material.

The foregoing and other objects of the present invention are accomplished by the provision of a refolding and stacking receptacle for reversely-foldable, segmented sheets of material which comprises broadly a substantially horizontal support for supporting a stack of the material in flat, refolded condition.

A substantially vertical guideway is positioned centrally of the support for receiving a leading end of a moving web of the sheet material fed gravitationally to the receptacle in an unfolded condition. Stop means associated with the guideway is positioned for arresting the motion of the sheet material. The depth of the guideway is less than the length of a single sheet material segment by an increment predetermined to make the material fold zig-zag fashion on the support surface. In this manner, as the web is fed continuously to the receptacle, it is guided and reversely folded continuously to build up a stack of the material in flat, refolded condition. Upon termination of the operation the stack may be easily removed for further processing.

DESCRIPTION OF PREFERRED EMBODIMENTS OF THE INVENTION

Figure 1:
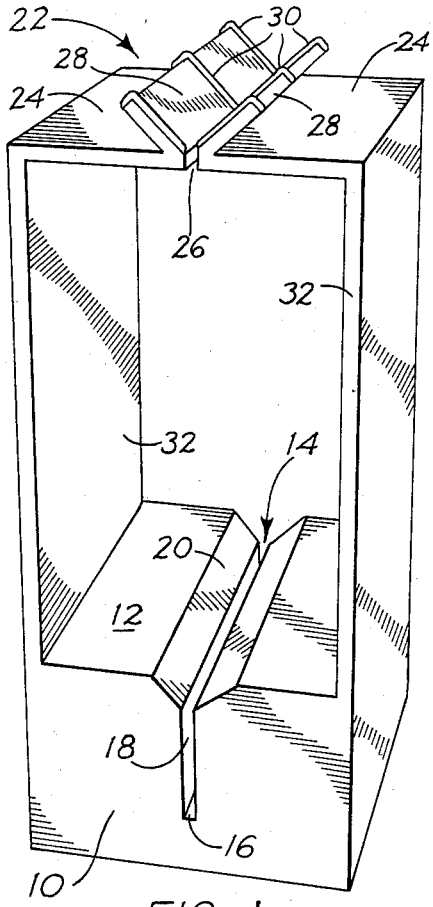
Figure 6:
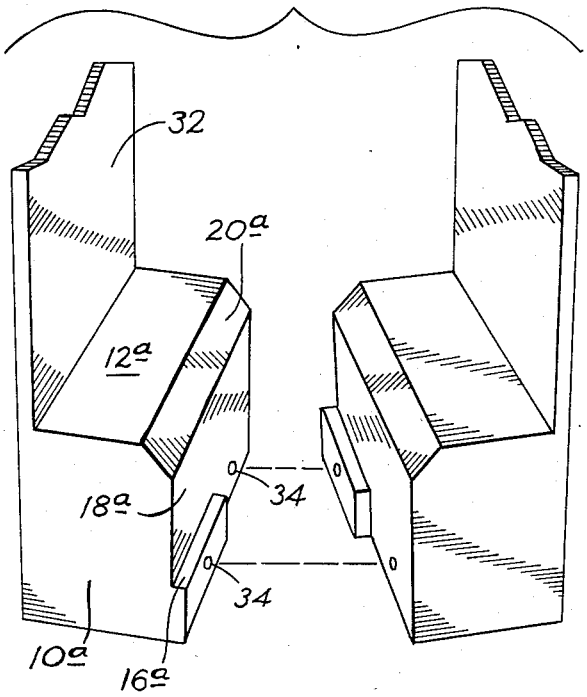
Figure 2:
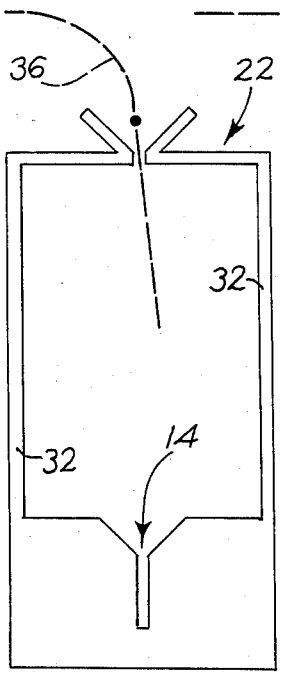

The preferred embodiments of the invention are described herein with particular reference to the drawings, wherein:

FIG. 1 is a perspective view of the receptacle;

FIGS. 2–5, inclusive, are side elevational views illustrating the operation of the receptacle in guiding, folding and stacking refoldable, segmented sheet material; and FIG. 6 is an exploded perspective view illustrating the receptacle in a second embodiment wherein the finished product may be composited from two identical halves.

The sheet material which the receptacle of my invention is designed to process may comprise a wide variety of continuous web materials, usually made from paper, although they also may be made from other materials such as selected sheet plastic materials. The web is divided into segments by creasing, perforating, or otherwise. The length of the segments, in the direction of web flow, is substantially uniform. However, the segment widths may be widely variable. They may be either single or multi-part.

In its use, the web of sheet material is normally provided as a stack in flat-folded, or accordion-pleated, condition. The leading end of the web is fed to a processing machine which draws the web through the machine in linear movement as it is processed. The moving web then is discharged from the machine, whereupon it gravitates downwardly in substantially vertical flow into a receiving receptacle, or "catch basket".

The receptacle desirably should serve the functions of guiding the flow of the web and promoting the reverse folding of its segments to form a neat stack of the material in flat-folded condition. The stack builds up during operation of the device and periodically may be removed for further processing.

The receptacle of my invention has particular application in the case where the web material comprises reversely-folded computer paper, the processing device is a computer-driven printer and the product of the operation is a computer printout. Its construction is illustrated in FIG. 1.

The receptacle comprises essentially a substantially horizontal support for supporting a stack of reversely-foldable, segmented sheet material in flat-folded condition, a substantially vertical guideway positioned centrally of the support for receiving the leading end of a moving web of the sheet material fed to the receptacle in unfolded condition and stop means associated with the guideway and positioned for arresting the linear movement of the web on contact, thereby promoting folding of the web.

In FIG. 1, the substantially horizontal support is indicated generally at 10 as a base member of substantial depth. It has a substantially flat upper surface 12 which is designed to support the stack of folded sheet material processed by, and stored in, the receptacle.

The combination guide and stop means associated with the support is indicated generally at 14. It comprises a terminated aperture or slot having a bottom 16, which acts as a stop, a shank guide portion 18 and an outwardly-flared upper guide portion 20.

The combination guide and stop receives the leading end of the descending web in the upper flared portion 20, guides it into the slotted shank portion 18 until it abuts the floor 16 of the slot. This arrests the linear motion of the web and initiates its reverse folding, the folds being received on upper surface 12 of support 10.

The combination guideway and stop thus in transverse cross section is of substantially Y-shaped configuration.

Second guide means spaced vertically from the first mentioned, or lower guide, cooperate with guide 14 in guiding the moving web. The two guides are held in substantially vertically aligned relationship to each other by suitable support means.

In the illustrated form of the invention, the upper guide is indicated generally at 22. It comprises a two-part base 24 defining a guide slot 26 which is aligned with, and spaced upwardly from, lower slot 18.

Outwardly flared guide plates 28 merge with slot 26 to form a guide unit which is substantially V-shaped in cross section.

Means are provided for overcoming the static electricity problem which often accompanies operation of devices of the class under consideration.

Such means comprise a plurality of spaced ribs 30 positioned parallel to each other on guide plates 28 and arranged in the direction of material flow. The ribs are provided in sufficient number to form a contact surface for the web material. Since the contact surface is of limited area, the tendency to generate static electricity is decreased correspondingly.

Although the upper guide assembly 24 may be independently supported, it is preferred to integrate it with the lower guide and stop assembly 10 by the provision of receptacle-defining side walls.

Preferably, there are two such side walls 32 which extend upwardly from the base on opposite sides and support the upper guide. They also serve as retaining guides for the stack of folded web material as it builds up.

The remaining opposite sides of the receptacle are left open for easy access, enabling removal of the stacked, flat-folded sheets whenever necessary or desirable.

It is to be noted that, for successful operation of the receptacle, side walls 32 should be arranged substantially parallel to lower guide 14, and spaced from it by a predetermined distance. In general, the depth of guide 14 including the width of its flared portion 20, plus the width of the connecting portion of base surface 12, should be greater than the length of one of the segments of the sheet material to be handled by the device. This insures that the first segment to be laid down will lie flat on surface 12, and get the stack started properly.

On the other hand, side walls 32 should be so located that the stated dimension is not greater than the segment length by an excessive amount. If this is the case, the side walls serve as stack guides, guiding the construction of the stack as it is built up, confining it, and preserving its upright and squared character.

It thus is possible to construct the receptacle from two identical halves, which may be easily and inexpensively fabricated from injection molded plastic. The manner in which this is accomplished is illustrated in FIG. 6.

The support base is formed in two sections 10*a*. These provide upper support surfaces 12*a*, and surfaces 18*a* which together define a slot which is terminated by stop surfaces 16*a*. Sloping surfaces 20*a* provide the outwardly flared guide positioned for reception of the leading end of the web material.

The base segments providing the stop surfaces 16*a* extend slightly less than half the width of the receptacle. Thus there are no lefts nor rights, and the two sections may be identical, simplifying their packaging, transportation and storage. They may be assembled in the manner indicated in FIG. 6, by inserting bolts in bolt holes 34 provided for that purpose.

The other elements of the assembly, i.e. side walls 32 and upper guide unit 24 may be identical with the same elements illustrated in FIG. 1.

OPERATION

The operation of the refolding and stacking receptacle of my invention is illustrated step-wise in FIGS. 2–5 inclusive.

The receptacle is placed adjacent the discharge of an associated computer-driven printer, or other device. It is a feature of the invention that the shape of upper guide unit 22 overcomes the necessity of having the receptacle exactly aligned with the printer discharge.

As the web gravitates downwardly, its leading end enters Y-shaped guide 14, the construction of which compensates for any slight misalignment of the feed with the guide.

Figure 3:
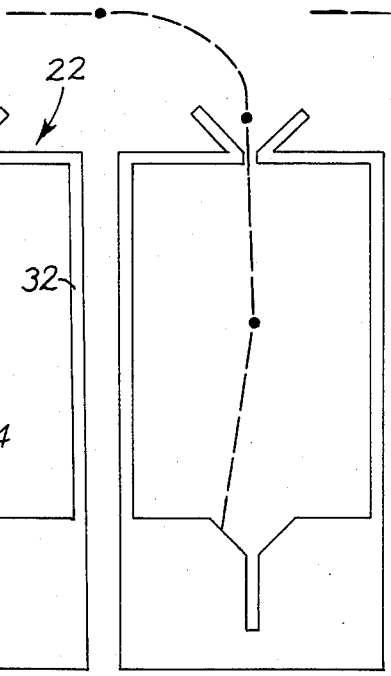

The linear movement of the web continues until it reaches the position of FIG. 3, whereupon the leading end of the web bottoms on the floor of guide 14. This acts as a stop, arresting the linear movement of the web.

Figure 4:
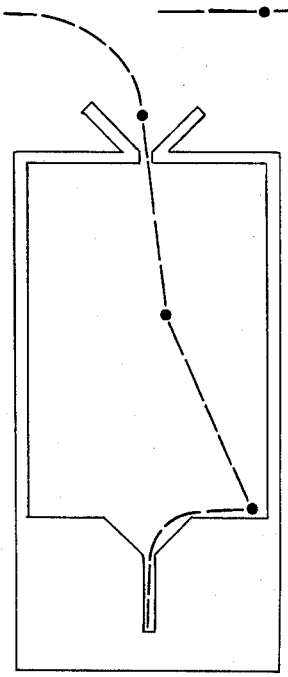
Figure 5:
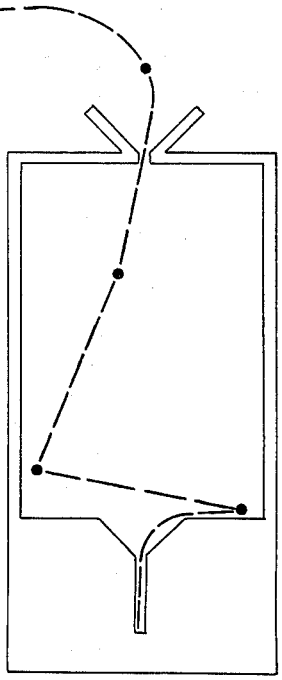

The folding operation then commences, as illustrated in FIG. 4. The first segment necessarily folds to the position of that figure, being retained in guide 14. In the next step, illustrated in FIG. 5, the reverse fold necessarily is made through the cooperative action of upper guide 22 in retaining the upstream portion of the web and thus limiting the horizontal movement of the web and keeping the feed centered.

The refolding sequence continues until the processing of the web has been completed. The resulting stack is built up within the receptacle, being confined by side walls 32, and being removable easily through the access opening on either side. Ribs 30 minimize the development of static electricity.

Having thus described my invention in preferred embodiments, I claim:

1. A refolding and stacking receptacle for receiving a web of linearly-moving, reversely-foldable, segmented sheet material comprising:

(a) a base member having a bottom support end and a substantially horizontal sheet support top end for supporting a stack of the material in flat-folded condition, (b) a substantially vertical guideway positioned centrally of the sheet support top end and extending downwardly therefrom for receiving the leading end of the moving web fed to the receptacle in unfolded condition, the upper end portion of the guideway being flared outwardly at its interception with the horizontal top end while retaining a major portion of the horizontal top end for supporting sheet material thereon, (c) stop means in the guideway below the sheet support top end for arresting the downward linear movement of the web, and (d) side walls extending upwardly from the outer ends of the sheet support top end substantially parallel to the plane of the guideway, (e) the linear distance from the stop means to one side wall being slightly greater than the length of one of the sheet material segments and the distance between the side walls being slightly greater than the length of one of the sheet material segments, to insure accommodation of the sheet material in flat-folded condition on the sheet support top end within the side walls.

2. A refolding and stacking receptacle for receiving the web of linearly-moving, reversely-foldable, segmented sheet material comprising:

(a) a base member having a bottom support end and a substantially horizontal sheet support top end for supporting a stack of the material in flat-folded condition, (b) a substantially vertical guideway positioned centrally of the sheet support top end and extending downwardly therefrom for receiving the leading end of the moving web fed to the receptacle in unfolded condition, (c) stop means in the guideway below the sheet support top end for arresting the downward linear movement of the web, (d) side walls extending upwardly from the outer ends of the sheet support top end substantially parallel to the plane of the guideway, (e) the linear distance from the stop means to one side wall being slightly greater than the length of one of the sheet material segments to insure accommodation of the sheet material in flat-folded condition on the sheet support top end within the side walls, and (f) an upper web-receiving guideway positioned a spaced distance above and substantially aligned vertically with the lower guideway.

3. The receptacle of claim 2 wherein the upper guideway comprises an aperture V-shaped in cross section.

4. The receptacle of claim 2 wherein the upper guideway comprises an aperture V-shaped in cross section, the guiding surfaces of the upper guideway including a plurality of spaced ribs positioned in the direction of material flow to reduce development of static electricity during filling of the receptacle.

5. The receptacle of claim 2 wherein the upper guideway comprises an upper base supported by the side walls and defining a web-receiving aperture therethrough substantially aligned vertically with the lower guideway.

* * * * *